United States Patent [19]

Stützle

[11] 3,958,510

[45] May 25, 1976

[54] ARRANGEMENT FOR VARIABLY ARMING A PROJECTILE AS IT EMERGES FROM A WEAPON BARREL

[75] Inventor: Dietmar Stützle, Lauf, Germany

[73] Assignee: DIEHL, Nurnberg, Germany

[22] Filed: Apr. 3, 1974

[21] Appl. No.: 457,636

[30] Foreign Application Priority Data

Apr. 5, 1973 Germany ..... 2316976

[52] U.S. Cl. ..... 102/70.2 G; 102/70.2 R

[51] Int. Cl.[2] ..... F42C 11/04; F42C 15/40

[58] Field of Search ..... 102/70.2 R, 70.2 G

[56] References Cited

UNITED STATES PATENTS

| | | | |
|---|---|---|---|
| 1,739,921 | 12/1929 | Schuler et al. | 102/70.2 G |
| 2,465,351 | 3/1949 | Busignies et al. | 102/70.2 G |
| 2,555,384 | 6/1951 | Watt | 102/70.2 G |
| 3,106,160 | 10/1963 | Harnau et al. | 102/70.2 G |

*Primary Examiner*—Charles T. Jordan

*Attorney, Agent, or Firm*—Walter Becker

[57] ABSTRACT

A circuit for controlling the electric fuse of a projectile which is fired from a weapon barrel having a control coil at the muzzle. A receiving coil in the projectile is energized in conformity with the degree of energization of the control coil and causes an ignition capacitor to develop an ignition voltage in conformity with the degree of energization of the receiving coil. The instant at which the ignition capacitor develops an ignition voltage thereon and causes detonation of the projectile is thus dependant upon the amount of current supplied to the control coil on the muzzle of the weapon barrel.

20 Claims, 4 Drawing Figures

Fig. 1
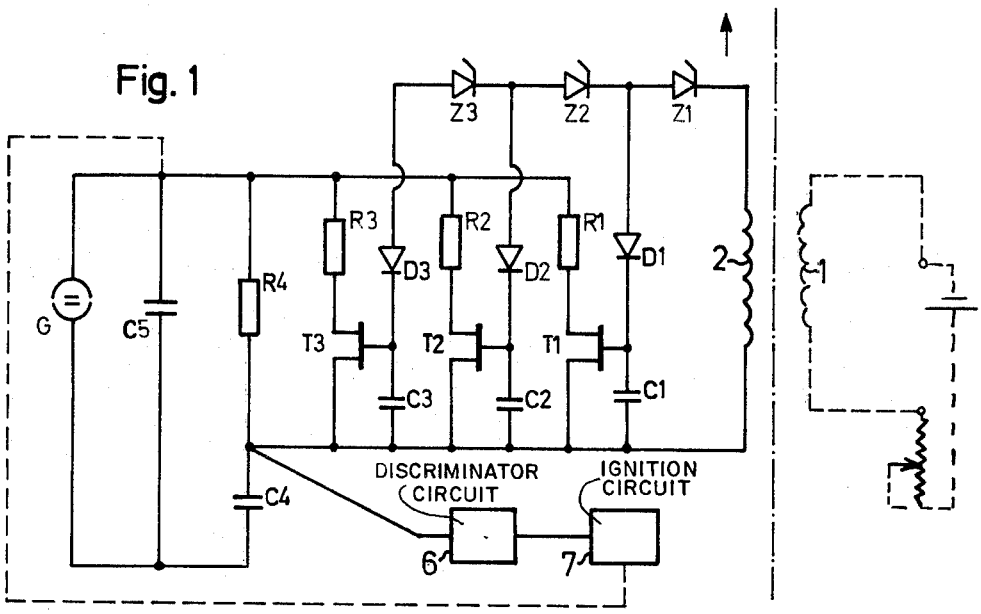
Fig. 2
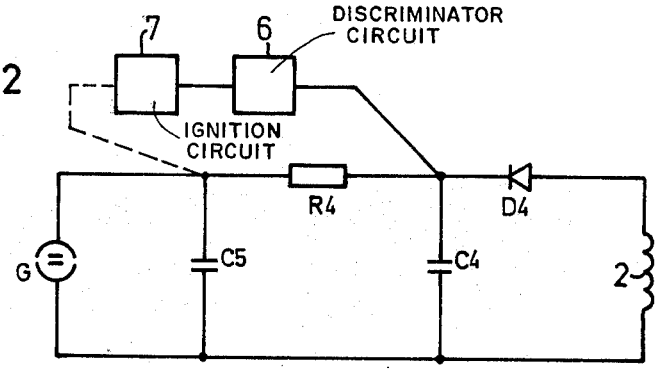
Fig. 3
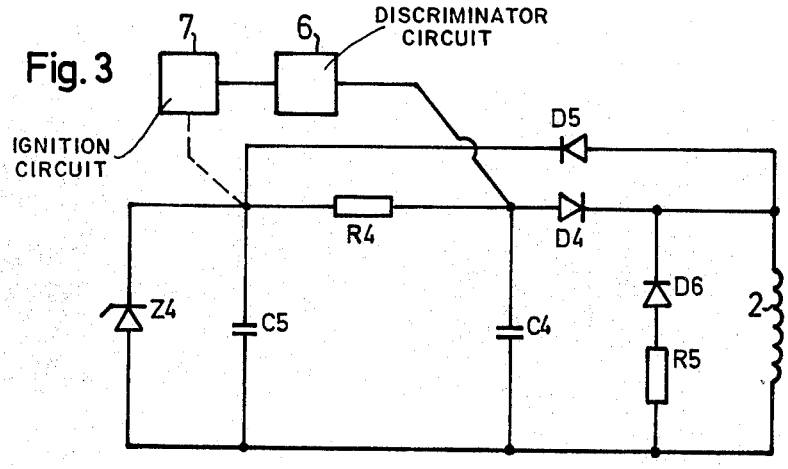
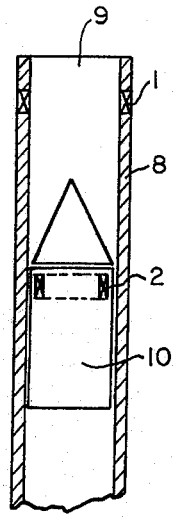
Fig. 4

ARRANGEMENT FOR VARIABLY ARMING A PROJECTILE AS IT EMERGES FROM A WEAPON BARREL

The present invention relates to an arrangement for programming the electric circuit of a projectile fuse by means of a control coil which is arranged on the muzzle of the barrel of the weapon, said coil being adapted during the passage of the projectile through the intervention of a receiving circuit of the projectile fuse to determine one or more rated values of the projectile, especially the time until the release of the fuse.

Arrangements of this type are known. The determination of the rated values is with heretofore known arrangements determined by a certain pulse sequence which acts upon the control coil and characterizes the value to be set in the fuse circuit. The programming of this value in the fuse circuit is effected while the fuse provided on the projectile passes through that portion of the barrel on which the control coil is provided. In this connection, means have to be provided which will make sure that the pulse sequence on the control coil will occur precisely when the receiving circuit of the projectile fuse passes through the control coil. The receiving circuit evaluates the received pulses and sets the fuse circuit accordingly. Such an arrangement requires on the emitter as well as the receiver side numerous elements and is liable to disorders.

It is an object of the present invention to provide an arrangement of the above mentioned type, in which a control signal is by the control coil induced in the receiving circuit which signal does not carry the information in partial signals which at the moment change at which the receiving circuit passes through the control coil. The control signal should be easily generated and on the other hand it should be possible to evaluate the control signal by a less expensive circuit.

These and other objects and advantages of the invention will appear more clearly from the following specification in connection with the accompanying drawing, in which:

FIG. 1 illustrates a receiving circuit of a projectile fuse according to which the programming of the ignition time is effected by changing the resistance value of the resistance unit for changing the charge.

FIG. 2 illustrates an embodiment of the receiving circuit according to which the programming of the ignition time is effected by a precharge of the ignition charge accumulator.

FIG. 3 illustrates a further embodiment of the receiving circuit in which the charge of said charge changing accumulator is effected by means of the voltage induced in the receiving coil.

FIG. 4 illustrates a projectile and muzzle end of a weapon barrel used with the receiving circuit of the present invention.

The problem underlying the present invention and set forth above has been solved according to the present invention by causing the control coil to be passed through by a current the intensity of which represents a measurement for the rated value to be set and in which the receiving circuit includes a receiving coil and means for evaluating the magnitude of the voltage which is induced in the receiving coil when the receiving circuit passes through the control coil. With this arrangement, a constant current passes through the control coil as long as the receiving circuit of the projectile fuse passes through the control coil. Depending on its intensity, this current builds up a more or less strong magnetic field in the interior of the control coil. Inasmuch as the exit velocity of the projectile is known, the magnitude of the voltage which is induced in the receiving coil when the receiving circuit passes through the control coil represents an indication or a value for the current flowing in the control coil and thus for the rated value to be set. Advantageously, the current passing through the control coil is a direct current.

According to a preferred embodiment of the invention, the electric circuit of the fuse is such that the point of initiation of the ignition is determined by the obtainment of a minimum voltage of an ignition charge accumulator which is adapted to be charged by a charge changing accumulator through the intervention of a charge changing resistor unit. The arrangement is further such that the duration of changing the charge is adapted to be controlled by the means for evaluating the magnitude of the voltage which is induced by the receiving circuit passing through the control coil. With a preferred embodiment of the invention, this control is effected by making the resistance value of the charge changing resistor unit adjustable during the passage of the receiving circuit through the control coil in conformity with the current flowing in said control coil. With this arrangement, the effective charge changing resistance is adjusted by the current flowing in the control coil or by the voltage induced in the receiving coil so that the operation of the charge changing from the charge changing accumulator to the ignition charge accumulator thus is effected either at a slower or faster rate and consequently the projectile is ignited later or sooner.

According to a preferred arrangement, variable resistor means are arranged in parallel branches to a charge changing resistor. Of these resistor means one or more are added to the charge over resistor depending on the magnitude of the voltage induced in the receiving coil, while in particular the resistor means include a resistor and a control element, especially a field effect transistor. The control elements are conductively controlled through a control circuit in conformity with the voltage induced in the receiving coil. Advantageously, the control circuits include swell value switches which correspond to the induced voltage in conformity with the magnitude thereof, and also include storage elements storing an obtained swell value. Depending on the magnitude of the induced voltage, one or more of the swell value switches respond whereby the control elements become conductive and thus a resistance is arranged in parallel with the charge changing resistance so that in toto the effective charge changing resistance is reduced. Inasmuch as the induced voltage occurs only briefly, whereas the field effect transistors have to be conductive and must remain conductive during the entire charge changing operation, there are provided the storing elements which store the obtained swell value.

As swell value switches Zener diodes are preferably employed which are followed by diodes. The diodes are intended to prevent the discharging of the storing element arranged in the control circuit of the field effect transistors.

According to a further embodiment of the invention, the receiving coil stores a precharge into the ignition charge storage means while the voltage value corresponding to the precharge is less than the minimum voltage necessary for the ignition. With this embodiment, the duration of the change in charge from the precharge storing means to the ignition charge storing means is influenced by the fact that the ignition charge storing means is precharged in conformity with the induced voltage so that the change in charge will last longer or shorter depending on the magnitude of the precharge.

According to a further development of the invention, the halfwave of the induced voltage charges the charge changing storage means, and the other half wave controls the described means for evaluating the magnitude of the induced voltage. With this arrangement, a voltage source of the fuse for itself which otherwise is provided for charging the charge changing storage means will be superfluous.

Referring now to the drawings in detail, FIG. 1 illustrates in dash line a control coil 1 which is provided at the muzzle of a weapon barrel. This control coil is passed through by a current the intensity of which is variable. The circuit shown on the left-hand side of the dot-dash line forms a part of the circuit for an electric projectile fuse.

The illustrated circuit includes a receiving coil 2 which is followed by a plurality of control circuits respectively comprising the Zener diodes Z1, Z2 and Z3, the diodes D1, D2, D3, and the condensers C1, C2 and C3. Respectively located between the diodes D1, D2, D3 and the condensers C1, C2, C3 there is located a field effect transistor T1, T2, T3 with its gate connection. Respectively arranged in series to the drain-source-section of the field effect transistor T1, T2, T3 there is provided a resistor R1, R2, R3. The resistors R1, -R3 and the drain-source-sections of the transistors T1-T3 are arranged parallel to each other and parallel to a resistor R4. Arranged in series with the resistor R4 there is located an ignition charge storage means formed by a condenser C4. Arranged in parallel with these series arrangement is a condenser C5 which forms a charge changing storing means. Arranged in parallel to the condenser C5 is a generator G. This generator may be formed by a piezo-generator known in connection with projectile fuse circuits or projectile ignition circuits or may be formed by a linear magnet generator. At the connecting point between the resistor R4 and the condenser C4 there is connected thereto a discriminator circuit 6 which responds to a certain voltage value of the condenser C4 and initiates or releases an ignition circuit 7. The ignition circuit 7 can be ignited in all instances from C5.

The operation of the described circuit is as follows: In the control coil 1 provided at the muzzle of a barrel, the direct current is set. This direct current will, in the interior of the coil and thus at the muzzle of the barrel, generate a magnetic field. If now the projectile is fired with the ignition circuit which contains the receiving coil 2, the receiving coil 2 flies through the magnetic field of the control coil 1. As a result thereof, a voltage is induced in the receiving coil 2. The magnitude of this voltage depends on one hand on the intensity of the magnetic field and thus on the direct current passing through the control coil 1, and on the other hand depends on the velocity at which the projectile flies through the control coil 1. Inasmuch as the velocity is the same with individual projectiles, it is possible by changing the current in the control coil 1 to obtain in the receiving coil 2 a voltage which is dependent only on the control coil 1. By coupling the programming device with the velocity measurement of the weapon, a systematic change in the velocity can be taken into consideration. Depending on the magnitude of the voltage induced in the receiving coil 2, the Zener diode Z1 or the Zener diodes Z1 and Z2 or the Zener diodes Z1 and Z2 and Z3 become conductive. Assuming that the induced voltage is just so high that the Zener diode Z1 has become conductive while the other Zener diodes Z2 and Z3 block, it will be appreciated that a positive voltage acts through diode Z1 at the gate connection of the field effect transistor T1 which positive voltage makes the field effect transistor conductive. The condenser C1 is charged to the voltage of the gate connection. It therefore will assure that the field effect transistor T1 will remain conductive also when a voltage is no longer in use in the receiving coil 2 because it left the magnetic field. The diode D1 prevents the condenser C1 from discharging.

The field effect transistor T1 presents only a very low resistance so that the resistance value of the series arrangement comprising the resistor R1 and the drain-source-section of the field effect transistor is determined substantially by the value of the resistor R1. The field effect transistor T2 and T3 are blocked. Their drain-source-section thus have a high resistance so that the resistance value of the parallel branches R2, T2, R3, T3 are determined substantially by these high resistances. Thus, only the resistor R1 is effectively arranged in parallel with the charge changing resistor R4. Thus, the total resistance of the charge changing resistor unit is reduced in comparison with the situation in which also field effect transistor T1 is blocked.

The condenser C5 was at the start of the firing operation of the projectile charged by the generator G to a certain voltage. During the flight of the projectile, the change in the charge of the condenser C5 through the charge changing resistance unit to the condenser C4 is effected. When the charge or voltage on the condenser C4 reaches a certain minimum voltage, the discriminator circuit 6 responds and emits a signal to the ignition circuit 7 whereby the ignition operation is initiated. Due to the described decrease in the resistance value of the charge changing resistance unit by means of the effective parallel arrangement of the resistor R1, the change in the charge from the condenser C5 to the condenser C4 proceeds at a faster rate than when the charge equalization is effected only through the resistor R4.

When the induced voltage is so high that also the Zenar diode Z2 switches through to the Zener diode Z1, also the resistor R2 will be in parallel to the resistor R4. The operation of this control operation is the same as that described above. The operation of the further stage which consists of the structural elements D3, C3, T3 and R3 corresponds to that of the preceding stages. It will be evident that in case of need also more than the illustrated three control circuits may be provided while with the parallel arrangement of each further resistor, the time for initiating the ignition by the fuse will be reduced further.

The Zener diodes may, however, also be so arranged that they are no longer in series with each other but that each one starts individually from the receiving coil 2. In such an instance, types with different breakdown voltage are selected. The resistors R1, R2 etc. may also be arranged in series with the resistor R4. The transistors T1, T2 etc. will then effectively bridge one of the resistors and will short-circuit the same for accelerating the chargeover process.

In FIG. 2, the arrangement and operation of the control coil 1 and the receiving coil 2 corresponds to that described in connection with FIG. 1. The arrangement and operation of the generator G of the condenser C5 of the resistor R4, of the condenser C4 and the discriminator circuit 6 and the ignition circuit 7 likewise correspond to that of FIG. 1. The receiving coil 2 is arranged in parallel with the condenser C4 through a diode D4. The voltage induced in the receiving coil 2 while the receiving circuit flies through the control coil charges the condenser C4 through the diode D4. The voltage thus obtained on the condenser C4 corresponds to the voltage induced in the receiving coil 2. The diode D4 prevents a discharge of the condenser C4 through the receiving coil 2 when the latter has left the magnetic field of the control coil. On the other hand, the diode D4 will see to it that only that half wave of the voltage induced in the receiving coil passes to the condenser C4 which corresponds to the forward direction of the diode D4.

The condenser C4 will thus after the receiving circuit has passed through the control coil have a certain predetermined precharge.

If the polarity of the charge of the condenser C5 and the precharge of the condenser C4 are of the same magnitude, the above described chargeover operation is effected through the resistor R4 until the minimum voltage is obtained at the condenser C4 to which the discriminating circuit 6 responds and thus initiates the ignition. This will be effected at a faster rate than if the condenser C4 would not have a precharge. Thus, with this arrangement the time for the ignition will with higher induced voltages be set shorter than with lower induced voltages. When dimensioning, it is to be taken into consideration that the induced voltage should be lower than the minimum voltage necessary for the ignition because otherwise the ignition will be effective already when the control coil flies through the magnetic field.

When the condenser C4 by changing the polarity of the diode D4 is charged to a polarity opposite to the polarity of the condenser C5, it will be appreciated that with higher induced voltages the time until the ignition is initiated will be longer than with low voltages because the change in the charge effected by the condenser C5 through the resistor R4 cancels the preload of the condenser C4 and has to bring the condenser C4 up to the minimum voltage necessary for the ignition.

The advantage of this arrangement over that described in connection with FIG. 1 consists in that the time for the ignition can be set in a stepless manner.

With the two above described embodiments, on one hand a generator G for charging the chargeover storage means formed by the condenser C5 is provided, and on the other hand only a half wave of the voltage induced in the receiving coil 2 is evaluated. In the following embodiment a generator for charging the condenser C5 is not necessary because the one half wave which is not used for control purposes is employed for this purpose.

In FIG. 3, the arrangement and operation of the control coil 1 and the receiving coil 2 as well as of the condenser C5 of resistor R4, of the condenser C4 and the discriminator circuit 6 and of the ignition circuit 7 correspond to those described in connection with the preceding embodiment. The arrangement and the operation of the diode D4 correspond to those described in connection with FIG. 2. Additionally, a diode D5 is connected to the receiving coil 2, said diode D5 having an opposite polarity as the diode D4. The diode D5 is connected to the condenser C5. Arranged in parallel with the condenser C5 is a voltage limiting element namely a Zener diode Z4. Arranged in parallel to the diode D4 and the condenser C4 is a series circuit comprising a diode D6 and a resistor R5. The diode D6 has the same polarity as the diode D4.

Assuming the polarity of the diodes illustrated in the drawing, the circuit just described operates as follows: The positive half wave of the voltage induced in the receiving coil 2 passes through diode D5 to the capacitor C5 and charges the same up to a limited voltage value as limited by the Zener diode Z4. The negative half wave passes through diode D4 to the condenser C4 and precharges the same. By the diode D6 and the resistor R5 it will be assured that the precharge of the condenser C4 will always remain lower than the charge of the condenser C5. The dimensioning has to be effected in such a way that the charge of the condenser C5 is sufficiently high in order to be able to bring the condenser C4 during the chargeover operation effected by the resistor R4 from its voltage obtained by the precharge of opposite polarity to the minimum voltage necessary for the ignition. In case of need — as illustrated in dash lines in FIG. 3 — also a supply voltage for the ignition circuit 7 may be derived from the condenser D5.

The circuit illustrated in FIG. 3 by means of which the generator G will not be necessary may also be provided with the circuit of FIG. 1.

FIG. 4 illustrates a weapon barrel 8 with a mouth 9 having a coil arranged therewith. In the weapon barrel 8 there is shot, shell or projectile 10 shown with the receiver coil 2.

It is, of course, to be understood that the present invention is, by no means, limited to the specific showing in the drawing but also comprises any modifications within the scope of the appended claims.

What is claimed is:

1. In combination with an arrangement for programming control circuitry for an electrically operated fuse of a projectile in which a first control coil on a muzzle of a weapon barrel through which the projectile passes develops a field which links a second receiving coil in the projectile and induces a voltage therein; the control circuitry in the projectile having a voltage sensitive igniter means, an ignition capacitor connected to said igniter means operable at a predetermined voltage to actuate said igniter means, a control capacitor, a charging circuit for said control capacitor operable to impart a predetermined charge thereto during travel of the projectile along the first control coil, a reload resistor connecting said control capacitor and said ignition capacitor in closed circuit for transfer of charge from the former to the latter, and charging means operable in response to said receiving coil passing through the field of said control coil to cause a precharge to build up on said ignition capacitor in conformity with the degree of energization of said control coil.

2. In an arrangement for programming control circuitry for an electrically operated fuse of a projectile in which a first control coil on a muzzle of a weapon barrel through which the projectile passes develops a field which links a second receiving coil in the projectile and induces a voltage therein; the control circuitry in the projectile having a voltage sensitive igniter means, an ignition capacitor connected to said igniter means operable at a predetermined voltage to actuate said igniter means, a control capacitor, a charging circuit for said control capacitor operable to impart a predetermined charge thereto during travel of the projectile along the weapon barrel, a resistor connecting said control capacitor and said ignition capacitor in closed circuit for transfer of charge from the former to the latter, and charging means operable in response to said receiving coil passing through the field of said control coil to cause a charge to build up on said ignition capacitor in conformity with the degree of energization of said control coil, said charging means comprising branch circuits in parallel with said resistor and each comprising a resistance and an electronic gate component in series, and each gate component becoming conductive in response to a respective voltage across said receiver coil.

3. An arrangement according to claim 2 in which each gate component has a control terminal and one end of said receiving coil is connected to each control terminal via respective zener diode means and respective other diode means, the other end of said receiving coil being connected to each control terminal via a respective further capacitor.

4. An arrangement according to claim 2 in which each said gate component is a semiconductor.

5. An arrangement according to claim 2 in which each said gate component is a field effect transistor.

6. An arrangement according to claim 3, in which said zener diode means are poled toward said receiving coil and a connection is made from the cathode side of each zener diode means to a respective control terminal.

7. An arrangement according to claim 6 in which each other diode means is poled toward the respective control terminal.

8. An arrangement according to claim 3 in which each further capacitor holds the respective gate component in conductive condition after the projectile has left the weapon barrel.

9. An arrangement according to claim 3 in which each zener diode means and the respective further diode means and further capacitor is in closed circuit with said receiving coil.

10. An arrangement according to claim 9 in which said zener means are in series.

11. An arrangement according to claim 9 in which said zener diode means are in series and are also in series with said receiving coil.

12. An arrangement according to claim 2 in which said ignition capacitor is in closed circuit with said receiving coil, and a diode in said circuit, said receiving coil charging said ignition capacitor to a value less than ignition value when the projectile passes from the weapon barrel.

13. An arrangement according to claim 12 in which the charge on said ignition capacitor is opposite in polarity to that on said control capacitor.

14. An arrangement according to claim 2 in which initiation of movement of the projectile along the weapon barrel imparts a charge to said control capacitor.

15. An arrangement according to claim 2 in which movement of the receiving coil through the field of said control coil imparts a charge to said control capacitor.

16. In an arrangement for programming control circuitry for an electrically operated fuse of a projectile in which a first control coil on a muzzle of a weapon barrel through which the projectile passes develops a field which links a second receiving coil in the projectile and induces a voltage therein; the control circuitry in the projectile having a voltage sensitive igniter means, an ignition capacitor connected to said igniter means operable at a predetermined voltage to actuate said igniter means, a control capacitor, a charging circuit for said control capacitor operable to impart a predetermined charge thereto during travel of the projectile along the weapon barrel, a resistor connecting said control capacitor and said ignition capacitor in closed circuit for transfer of charge from the former to the latter, and charging means operable in response to said receiving coil passing through the field of said control coil to cause a charge to build up on said ignition capacitor in conformity with the degree of energization of said control coil, movement of the receiving coil through the field of said control coil imparting a charge to said control capacitor, one half wave of the voltage induced in said receiving coil as it passes through the field of said control coil charging said control capacitor and the other half actuating said charging means for said ignition capacitor.

17. An arrangement according to claim 16 which includes means in parallel with said control capacitor to limit the voltage thereacross.

18. An arrangement according to claim 17 in which said means is a zener diode.

19. An arrangement according to claim 16 in which a first diode poled in one direction connects one end of said receiving coil to said control capacitor and a second diode poled in the opposite direction connects the said one end of the receiving coil to said ignition capacitor.

20. An arrangement according to claim 19 which includes unidirectional damping means connected in parallel with said receiving coil and effective when said second diode is passing current.

* * * * *